United States Patent [19]

Murai et al.

[11] Patent Number: 4,863,845

[45] Date of Patent: Sep. 5, 1989

[54] INTERNAL LATENT IMAGE TYPE DIRECT POSITIVE SILVER HALIDE EMULSIONS AND PROCESS FOR PRODUCING THE SAME

[75] Inventors: Ashita Murai; Hiroyuki Mifune; Tatsuo Heki, all of Kanagawa, Japan

[73] Assignee: Fuji Photo Film Co., Ltd., Kanagawa, Japan

[21] Appl. No.: 82,922

[22] Filed: Aug. 6, 1987

Related U.S. Application Data

[63] Continuation of Ser. No. 744,727, Jun. 14, 1985, abandoned.

[30] Foreign Application Priority Data

Jun. 15, 1984 [JP] Japan ..... 59-122983

[51] Int. Cl.[4] ..... G03C 1/08; G03C 1/485

[52] U.S. Cl. ..... 430/569; 430/567; 430/603; 430/604; 430/605; 430/940; 430/943

[58] Field of Search ..... 430/569, 940, 604, 605, 430/567, 603, 943

[56] References Cited

U.S. PATENT DOCUMENTS

| | | | |
|---|---|---|---|
| 1,573,596 | 2/1926 | Wall et al. | 430/572 |
| 1,574,944 | 3/1926 | Sheppard | 430/603 |
| 2,618,556 | 11/1952 | Hewitson et al. | 430/642 |
| 3,574,628 | 4/1971 | Jones | 430/567 |
| 3,672,900 | 6/1972 | Kurz | 430/598 |
| 3,697,281 | 10/1972 | Milton | 430/596 |
| 3,761,276 | 9/1973 | Evans | 430/547 |
| 3,957,490 | 5/1976 | Libeer et al. | 430/599 |
| 4,332,887 | 6/1982 | Gerber | 430/569 |
| 4,395,478 | 7/1983 | Hoyen | 430/940 |
| 4,444,874 | 4/1984 | Silverman et al. | 430/940 |
| 4,665,017 | 5/1987 | Mifune et al. | 430/569 |

OTHER PUBLICATIONS

Research Disclosure 17643, Dec. 1978.

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

In an internal latent image type direct positive silver halide emulsion containing core/shell type silver halide grains wherein at least light-sensitive sites of the silver halide internal core which has been subjected to doping with metal ions or chemical sensitization, or both, is covered with a silver halide outer shell, the improvement wherein a photographic additive which is adsorbed on silver halide in said emulsion or interacts with silver ion, said additive being a compound which functions to change the crystal form or particle size of the silver halide grains in the case of the formation thereof or acts as a sensitizer or a sensitizing assistant in the case of chemically sensitizing the core particles but has a harmful influence on photographic properties if it remains after use of it, is deactivated by a deactivator prior to completion of the formation of said core/shell type silver halide grains or completion of surface chemical ripening of said grains. A process for producing the above internal latent image type direct positive silver halide emulsion is also disclosed.

36 Claims, No Drawings

INTERNAL LATENT IMAGE TYPE DIRECT POSITIVE SILVER HALIDE EMULSIONS AND PROCESS FOR PRODUCING THE SAME

This is a continuation of application Ser. No. 744,727, filed 6/14/85, now abandoned.

FIELD OF THE INVENTION

The present invention relates to internal latent image type core/shell direct positive silver halide photographic emulsions and a process for producing the same.

BACKGROUND OF THE INVENTION

It is known to produce an internal latent image type core/shell direct positive silver halide emulsion as described below.

In Japanese Patent Application (OPI) 136641/82 (the term "OPI" as used herein refers to a "published unexamined Japanese patent application"), a process for producing an internal latent image type core/shell emulsion useful as a direct emulsion is described. The process comprises carrying out chemical ripening of the surface of core/shell type silver halide grains in an internal latent image type emulsion in the presence of a polymer such as poly(N-vinylpyrrolidone), poly(N-vinyloxazolidone), a vinyl alcohol-N-vinylpyrrolidone copolymer or an N-vinylpyrrolidone-vinyl acetate copolymer, where the core/shell type silver halide grains are obtained by precipitating an outer shell (shell) of silver halide to cover at least light-sensitive sites on an internal nucleus particle (core particle) of silver halide subjected to doping with a metal ion, chemical sensitization or both.

In Japanese Patent Publication 34213/77 (U.S. Pat. No. 3,761,276, Evans), an internal latent image type emulsion useful as a direct positive emulsion is described. This emulsion is characterized by the fact that a doping agent is contained in the inner part of silver halide grains and the surface of the grains is chemically sensitized. The same type of emulsion is also disclosed in U.S. Pat. No. 3,317,322, Porter et al.

On the other hand, in the case of preparing the above described internal latent image type core/shell direct positive silver halide emulsions, it is known that internal latent image type core-shell silver halide emulsions having good reversal performance which are suitable for the desired purpose can be produced using various kinds of photographic additives.

For example, silver halide grains having a large particle size and a narrow particle size distribution (namely, uniform particle size) are obtained by adding a sulfur containing compound such as a thione compound as described in Japanese Patent Application (OPI) 82408/78 or 144319/78 or a thioether compound as described in U.S. Pat. No. 3,574,628 during the formation of the silver halide grains. These compounds are known as silver halide solvents and have the advantage that a hard tone high speed direct positive emulsion is obtained by addition in the case of forming the internal nucleus particles (core) of the internal latent image type core/shell silver halide grains. Further, there is the advantage that the light-sensitive sites of the core particles can be well covered in a very short time, if the above described sulfur containing compound is added in the case of precipitating the outer shell (shell) of the silver halide on the core particles.

Further, silver halide grains having a desired crystal form or particle size can be produced by adding a dye in the case of forming silver halide grains as described in Japanese Patent Application (OPI) 26589/80, and direct positive emulsions having a desired crystal form are obtained by adding the dye in the case of forming the core particles of internal latent image type core/shell silver halide grains or in the case of precipitating the shell on the core particles.

When a sulfur containing compound which is strongly adsorbed on the surface of silver halide grains to restrain the growth thereof (hereinafter referred to as a "sulfur containing restrainer") such as mercaptotetrazoles, mercaptotriazoles, mercaptothiazoles or benzothiazole-2-thiones, etc., is added in the case of the formation of the core particles of internal latent image type core/shell silver halide grains, fine silver halide grains having a comparatively uniform particle size can be obtained. The sulfur containing compounds, including the above described sulfur containing silver halide solvents, permit large silver halide grains having a comparatively uniform particle size to be obtained and have the advantage that the particle size of the core particles can be easily controlled at will. Further, when the above described sulfur containing restrainer is used in the case of the formation of the core particles or in the case of the precipitation of the shell, silver chloride (regular octahedral or rhombododecahedral) and silver iodobromide (rhombododecahedral) having a singular crystal form which is difficult to obtain by conventional processes can be sometimes obtained, which particles have high utility for various purposes. Moreover, it has been known that when a thione compound as described in Japanese Patent Application (OPI) 29829/80 is used in the case of carrying out chemical sensitization of the core particles of internal latent image type core/shell silver halide grains, the function of a gold sensitizer is effectively promoted to obtain a high speed direct positive emulsion.

These sulfur containing compounds (sulfur containing silver halide solvents, sulfur containing restrainers and sulfur containing sensitizing assistants) and dyes act as effective photographic additives, respectively, in each step in the case of preparing an internal latent image type core/shell silver halide emulsion. The preparation of an internal latent image type core/shell silver halide emulsion is generally roughly divided in four steps, namely: (1) formation of core particles, where the core particles may be doped with metal ion; (2) chemical sensitization of core particles; (3) precipitation of a shell on the core particles; and (4) surface chemical ripening of core/shell silver halide grains. However, they frequently have a harmful influence on subsequent steps. For example, a sulfur containing restrainer used in the case of the formation of core particles in step (1) remarkably restrains reaction in the case of chemical sensitization of the core particles in step (2), or a silver halide solvent used in step (1) or (3) puts the chemical ripening centers formed by surface chemical ripening of the core/shell emulsion in step (4) into the inner part of the grains so as not to form effective surface chemical sensitization centers, or a sulfur containing compound or a dye used in steps (1) to (4) remains on the surface of the core/shell silver halide grains after completion of step (4) to obstruct adsorption of spectral sensitizers, various photographic stabilizers (for example, hydroxytetraazaindenes, etc.) or nucleating agents, etc. Such problems are also observed in conventional surface latent image type silver halide emulsions for forming negative images. However, since preparation of internal latent image type core/shell silver halide emulsions generally comprises four steps as described above, it has been greatly desired that photographic additives effective in each step do not have any influence upon the subsequent steps.

Some examples of characteristic of internal latent image type core/shell silver halides are described in the following. The character of the surface chemical ripening of internal latent image type core/shell silver halide emulsions is fairly different from surface chemical ripening of conventional surface latent image type silver halide emulsions, and a required aspect is to make the surface sensitivity of the core/shell emulsion remarkably low as compared with the internal sensitivity of the core/shell emulsion so that latent images are formed in the inner part of the grains. Accordingly, surface chemical ripening of the core/shell silver halide grains should be weak as compared with surface chemical sensitization of surface latent image type silver halide grains and, consequently, surface chemical ripening of the core/shell silver halide grains is easily affected by residual sulfur containing compound or dye.

In core/shell silver halide grains, chemically ripening the surface of said grains is carried out in order to increase the maximum density ($D_{max}$) of the reversal image obtained by direct reversal processing. If the above described sulfur containing compound or dye is present in the case of carrying out surface chemical ripening, the maximum density obtained ($D_{max}$) becomes low or saturation of the maximum density ($D_{max}$) requires a long time because the surface sensitive centers formed are buried or surface chemical ripening is remarkably retarded. As means for increasing maximum density ($D_{max}$), there is one process where the degree of surface chemical sensitization is slightly enhanced. However, if the surface chemical sensitization is excessively carried out (beyond the optimum range), the minimum density ($D_{min}$) of the reversal images increases or the sensitivity of re-reversal images (negative images) increases, and good reversal performance cannot be obtained.

The fact that saturation of maximum density ($D_{max}$) requires a long time means that the reversal performance (particularly, $D_{max}$) change due to a small change in the time for surface chemical ripening is great, which is disadvantageous from the viewpoint of producing the internal latent image type core/shell silver halide emulsions in a stable manner.

Further, since the surface chemical ripening centers of the internal latent image type cores/shell emulsions are weak, photographic properties are easily affected by various additives (for example, spectral sensitizers or stabilizers; hereafter referred to as "finish additive(s)") added before application to a base after production of the core/shell emulsion. These finish additives are adsorbed on the surface of the core/shell silver halide grains to cause a desired effect. However, if a sulfur containing compound or dye used in the preparation of the core/shell silver halide emulsion remains adsorbed on the surface of the silver halide grains in the case of adding the finishing additives to the core/shell silver halide emulsion, they are adsorbed on the surface of silver halide grains in competition with the compound or due and, consequently, adsorption is unstable and stability with the passage of time is inferior. Particularly, in core/shell silver halide grains as described above, photographic properties ($D_{max}$, $D_{min}$, reversal image sensitivity and re-reversal image sensitivity) are greatly changed by adsorption of the finish additives, if adsorption of the finish additives is unstable or changes with the passage of time, and photographic properties unpredictably change. Therefore, there is a serious problem from the viewpoint of providing stabilized coated light-sensitive materials.

In the production of internal latent image type core/shell silver halide emulsions, it has been highly desired that, after photographic additives (particularly, sulfur containing compounds or dues) are effectively used in each step, they have no influence on the next step. Sulfur containing compounds and dues as described above are very strongly adsorbed on silver halide grains and are not desorbed by conventional desorption processes such as a reduction of pH or an increase of pAg, and many of them cannot easily be removed by washing the emulsion with water. Accordingly, it has been desired to develop a novel process for removing sulfur containing compounds or dyes.

Further, in Japanese Patent Application (OPI) 66727/78, a special process for producing internal latent image type direct positive silver halide emulsions is disclosed. Specifically, it is proposed that re-reversal negative images in high illumination exposure areas which are caused in an internal latent image type emulsion containing 10 mol % or less of silver iodide, which is produced by reacting at least 80 mol % based on the total amount of water soluble iodide with silver salt after formation of ¼ the molar amount based on the total amount of silver halide, in a step of forming silver halide grains by reacting a silver salt with a water soluble halide, can be prevented by adding an oxidizing agent after production of the emulsion but before addition of couplers, etc.

In Japanese Patent Application (OPI) 70221/83, a process where "acid-processed gelatin" is used as the gelatin added in the case of setting after production of an internal latent image type direct positive silver halide emulsion is proposed. This process is described as having the effect that photographic performance does not deteriorate during setting and preservation of the emulsion.

In internal latent image type core/shell direct positive silver halide emulsions, there is a tendency that re-reversal images are formed to a great extent with increases in sensitivity or maximum density ($D_{max}$), and there is the tendency that storage stability or production stability is deteriorated.

Particularly, in the production of practical emulsions to which various kinds of photographic additives are added, it has been desired to achieve good production stability for the emulsion. Requirements for good production stability include, for example, the following.

(1) The core/shell silver halide exhibits rapid surface post-ripening (whereby $D_{max}$ is stabilized) ("rapid surface post-ripening" means that $D_{max}$ reaches saturation in the early stages of post-ripening).

(2) The core/shell silver halide emulsion has good dissolution stability with the passage of time (the term "good dissolution stability with the passage of time" means that the photographic performance of a finished coating solution (silver halide emulsion prepared so as to be applied to a base) after all desired additives are added remains unchanged with the passage of time. In this sense, it is different from "preservation stability" of the photographic light-sensitive material after the finished emulsion has been applied to a base.).

In the production of internal latent image type core/shell direct positive emulsions, it has been desired to overcome the above problems. However, satisfactory results have not been obtained by processes for producing emulsions as hereto proposed.

SUMMARY OF THE INVENTION

An object of the present invention is to provide internal latent image type core/shell direct positive silver halide photographic emulsions which solve the prior art problems as they simultaneously have high sensitivity, high $D_{max}$, low $D_{min}$, lowered occurrence of re-reversal negative images, good preservation stability and good production stability, and a process for producing the same.

As a result of extensive research, the inventors found that the above object of the present invention could be attained by providing the following emulsion and a process for producing the same.

(1) An internal latent image type direct positive silver halide emulsion containing core/shell type silver halide grains wherein at least light-sensitive sites of the silver halide internal nucleus particle (core) which is subjected to doping with metal ions or chemical sensitization, or both, are covered with a silver halide outer shell (shell), wherein a photographic additive which is adsorbed on silver halide in the emulsion or interacts with silver ions (the additive being a compound which functions to change the crystal form or particle size of the silver halide grains in the case of formation thereof or acts as a sensitizing assistant in the case of chemically sensitizing the core particles but has a harmful influence (i.e., an adverse effect) on photographic properties if it remains after use) is deactivated by a deactivator as later defined prior to completion of formation of the core/shell type silver halide grains or completion of surface chemical ripening (post-ripening) of the grains.

(2) A process for producing an internal latent image type direct positive silver halide emulsion containing core/shell type silver halide grains which comprises forming silver halide internal nucleus particles (core) doped with metal ion(s) or chemical sensitization, or both, and thereafter covering at least light-sensitive sites of the internal core with an outer shell (shell), wherein the process comprises using a photographic additive which functions to change crystal form or particle size of the silver halide grains in formation thereof or acts as a sensitizing assistant in the case of chemically sensitizing the core particles but has a harmful influence on photographic properties if it remains after use (the photographic additive is one which is adsorbed on silver halide in the emulsion or interacts with silver ions), and thereafter deactivating it with a deactivator as later defined prior to completion of the formation of the core/shell silver halide grains or completion of surface chemical ripening (post-ripening) of the grains.

DETAILED DESCRIPTION OF THE INVENTION

The term "an internal latent image forming emulsion" can be clearly defined by the fact that it provides greater maximum density when developed with an "internal" developing solution than it provides when developed with a "surface" developing solution.

Internal latent image forming silver halide emulsions suited for the present invention are those which, when coated on a transparent support, exposed for a definite time of 0.01 to 1 second, and developed in the developer A (internal developer) as described below at 20° C. for 3 minutes, provide a maximum density (measured according to an ordinary photographic density measuring method) of at least five times as much as the maximum density obtained by exposing them in the same manner and developing in the developer B (surface developer) as described below at 20° C. for 4 minutes. Preferable emulsions are those which provide, when developed in developer A, a maximum density more than 10 times that obtained by developing them in developer B.

| | |
|---|---|
| Developer A | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 liter |
| Developer B | |
| p-Hydroxyphenylglycine | 10 g |
| Sodium Carbonate | 100 g |
| Water to make | 1 liter |

The term "in the case of formation of silver halide grains" includes after completion of formation of shells.

The term "deactivation" means that the adsorptive action in silver halide or interaction with silver ions of the photographic additive (hereafter referred to as a "substance to be deactivated") is reduced or lost by a irreversible chemical reaction. Whether the substance to be deactivated is deactivated or not can be confirmed by a dielectric loss method in which densities of silver ions existed between silver halide crystal lattice (i.e., ion conductivities) are measured. When a photographic additive which interacts with silver ions is present in a silver halide emulsion layer, the silver ion density described above decreases and the ion conductivity is low. On the other hand, when the photographic additive is deactivated, the silver ion density increases and the ion conductivity becomes high. The term "interaction with silver ions" means a chemical reaction or an ion bonding with silver ions.

The term "photographic properties" includes, for example, a reversal image sensitivity, a re-reversal image sensitivity, $D_{max}$, $D_{min}$, a dissolution stability with the passage of time of silver halide emulsions, a preservation stability of light-sensitive materials obtained by using the finished emulsions.

According to the present invention, "progress of surface post-ripening", which is a problem in the production of internal latent image type core/shell direct positive emulsions, is improved to obtain photographic emulsions showing stabilized $D_{max}$. In order to increase the progress of surface post-ripening, the time of deactivating the substance to be deactivated by a deactivator is important, and it is particularly preferred to carry out deactivation prior to the start of surface chemical ripening (post-ripening).

Further, according to the present invention, "dissolution stability with the passage of time" of the finished emulsions is improved and "preservation stability" of photographic light-sensitive materials prepared by applying the finished emulsions is remarkably improved.

Further, emulsions of the present invention show improved spectral sensitization, because spectral sensitizing dyes believed to be not suitable for practical use because of having a poor adsorbing power to silver halide can be effectively used.

Moreover, according to the present invention, photographic emulsions having high sensitivity, high $D_{max}$ and low $D_{min}$ which undergo less re-reversal negative image formation are obtained.

It was unexpected in the production of internal latent image type core/shell direct positive photographic emulsions that the above described desirable effects could be obtained by deactivating photographic additives by a deactivator at a specific time, namely, "prior to completion of formation of the core/shell silver halide grains or completion of surface chemical ripening of the grains". Hitherto, the art believed that used additives should be removed by washing with water or controlling pH. However, the concept that they can effectively be deactivated by a deactivator at a specific time is a novel concept not suggested in the prior art of producing emulsions.

As examples of substances to be deactivated used in the present invention, there are photographic additives which change or make uniform the crystal form or particle size in the formation of silver halide grains or act as sensitizers or sensitizing assistants in the case of chemical sensitization of core particles, such as sulfur containing silver halide solvents, sulfur containing sensitizers, dyes, sulfur containing restrainers or assistants used for gold sensitization, etc. Particularly, substances which are not removed from emulsions by washing with water or controlling pH, such as dyes or sulfur containing compounds adsorbed on silver halide through a sulfur atom (ion or radical) are preferably used.

The above described sulfur containing silver halide solvents are those which dissolve silver chloride in an amount more than two time (by weight) the amount of silver chloride which can be dissolved at 60° C. in water or a mixture of water and an organic solvent (for example, water/methanol=1/1, etc.) when 0.02 mol of silver halide solvent are present.

Examples of sulfur containing silver halide solvents include thiocyanates, organic thioether compounds, thione compounds and mercapto compounds. In greater detail, there are the compounds described in Japanese Patent Application 232069/83 (filed on 8, Dec., 1983 by Fuji Photo Film Co., Ltd.), pages 8 to 23 (corresponding to U.S. Pat. Application Ser. No. 679,651, filed on 7, Dec., 1984), the compounds described in Japanese Patent Application (OPI) 77737/80, pages 195 and 196, the thione compounds described in Japanese Patent Applications (OPI) 144319/78 and 824008/78 and the thioether compounds described in the above described patent applications.

As the above described sulfur containing sensitizers, there are thiosulfates, thioureas, thiazoles, rhodanines, etc. Examples include those described in U.S. Pat. Nos. 1,574,944, 2,410,689, 2,278,947, 2,728,668 and 3,656,955 and Japanese Patent Application (OPI) 45016/80.

Examples of dyes useful in the case of forming silver halide grains, there are methine dyes as described in Japanese Patent Applications (OPI) 26589/80, 102733/78, 110012/77 and 18142/83, Japanese Patent Publications 102733/78 and 28027/76, and U.S. Pat. Nos. 2,735,766, 4,006,025, 4,183,756 and 4,225,666, etc.

The methine dyes useful in the present invention include polymethine dyes, including cyanine, merocyanine, complex cyanine, complex merocyanine, oxonol, styryl, hemicyanine, hemioxonol, merostyryl and streptocyanine, and azapolymethine dyes where a methine group in the methine chain is replaced with a nitrogen atom.

The cyanine dyes useful in the present invention contain two basic heterocyclic nuclei bonded by methine condensation, such as those derived from quinolinium, pyridinium, isoquinolinium, 3H-indolium, benzo(e)indolium, oxazolium, oxazonlinium, thiazolinium, thiazolium, selenazolium, selenazolinium, benzoxazolium, benzothiazolium, imidazolium, imidazolinium, benzimidazolium, naphthoxazolium, naphthothiazolium, naphthoselenazolium, naphthoimidazolium, dihydronaphthothiazolium, dihydronaphthoselenazolium, pyrylium, imidazopyrazinium, imidazo(4,5-b)quinoxalium, pyrrolidinium, quanternary salts and indole nuclei. Generally, one can use cyanine dyes useful for spectral sensitization of silver halide emulsions or useful for improving stability such as preventing fog, etc., in the present invention.

Useful merocyanine dyes in the present invention include those where an acid nucleus derived from barbituric acid, 2-thiobarbituric acid, rhodanine, hydantoin, 2-thiohydantoin, 2-pyrazolin-5-one, 2-isoxazolin-5-one, indane-1,3-dione, cyclohexane-1,3-dione, 1,3-dioxane-4,6-dione, pyrazoline-3,5-dione, 2-thiooxazolidine-2,4-dione, pentane-2,4-dione, alkylsulfonylacetonitrile, arylsulfonylacetonitrile, malonic acid diester, malononitrile, isoquinoline-4-one, coumarone-2,4-dione or pyrazolo(5,1-b)quinazoline, etc., and a basic nucleus used in cyanine dyes are condensed by a methine bond.

Examples of the methine dyes useful in the present invention are set forth below, but the present invention should not be construed as being limited thereto.

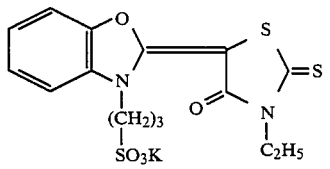

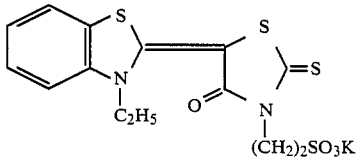

-continued
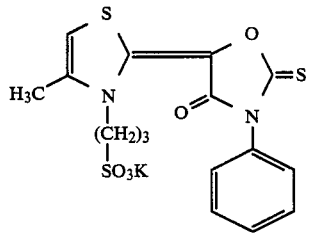
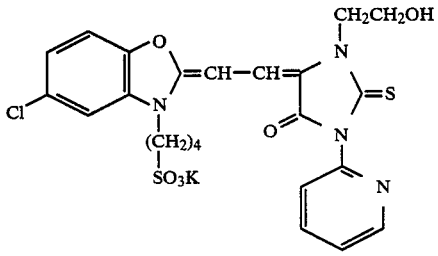
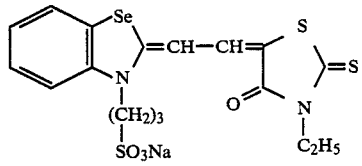
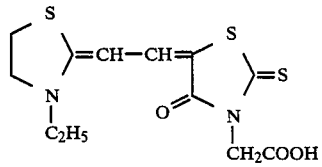
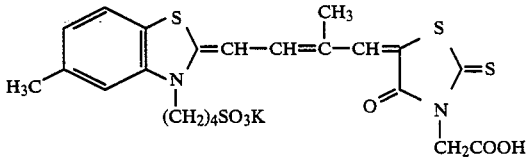
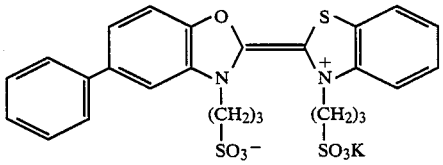
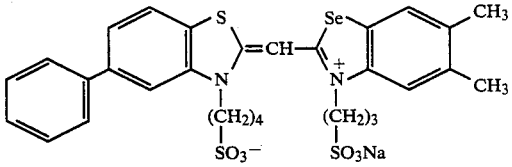
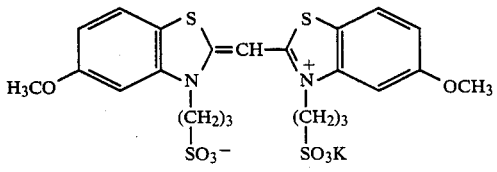

-continued
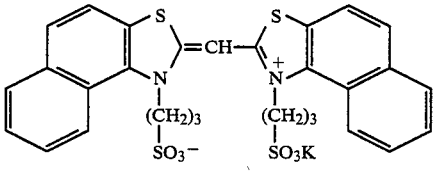
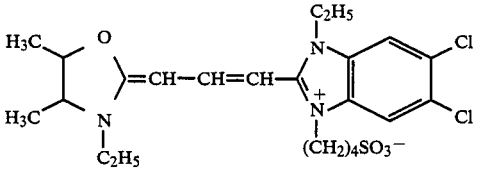
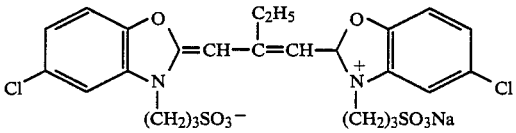
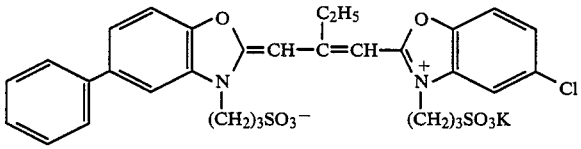
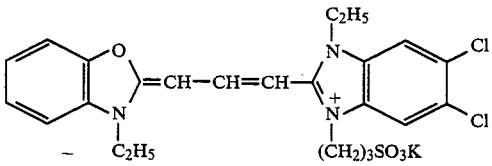
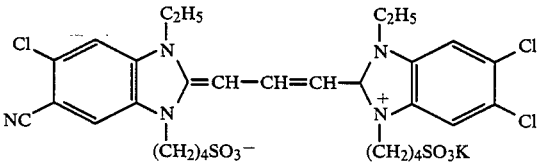
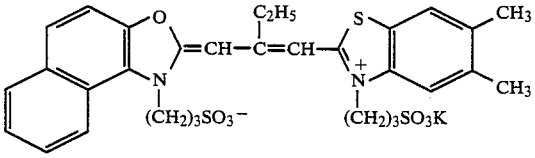
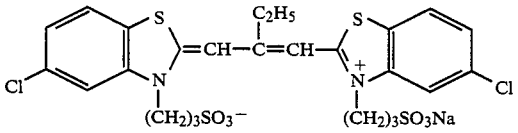
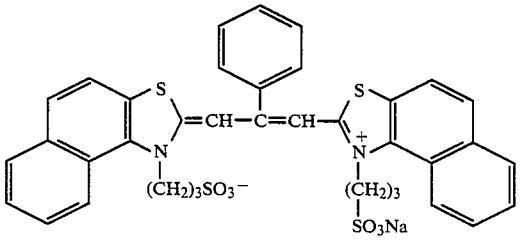

-continued
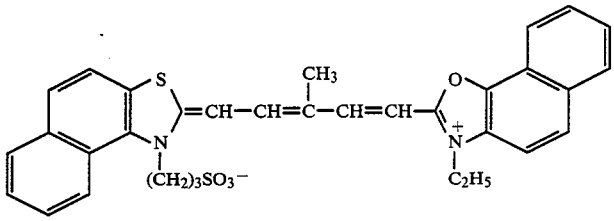
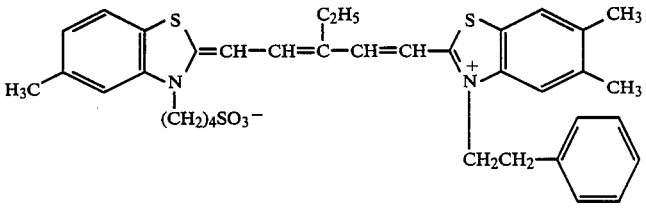
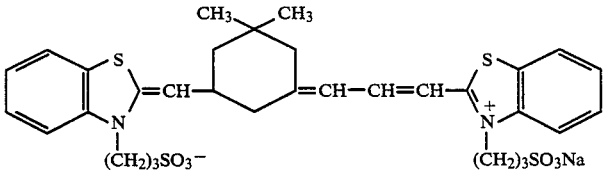
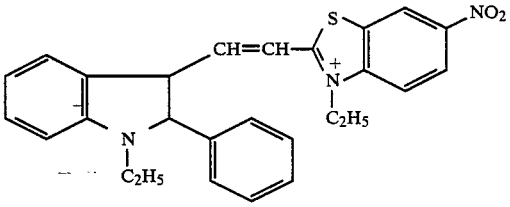
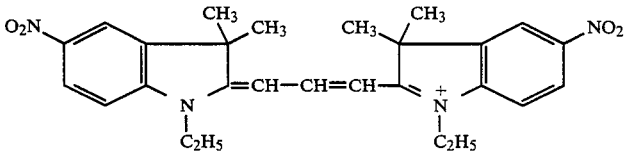
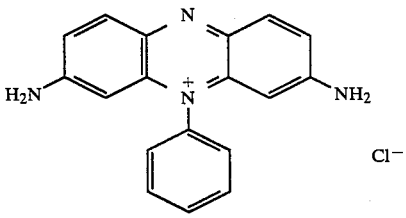
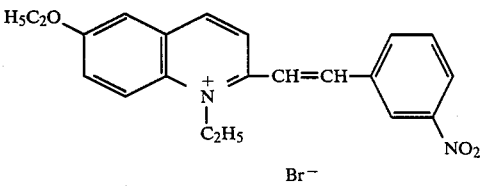

-continued

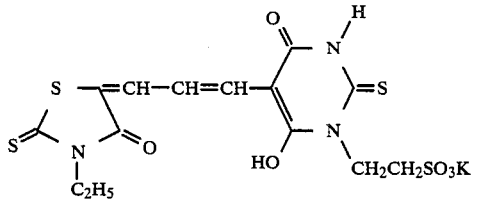

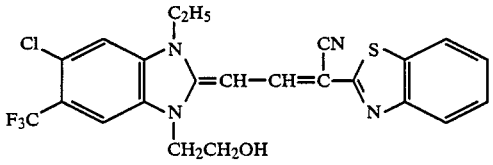

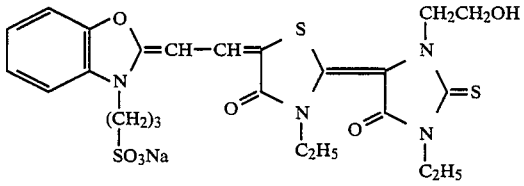

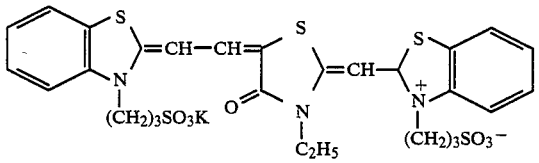

Other literature incorporated by reference where methine dyes useful in the present invention are described include F. M. Hamer, *The Chemistry of Heterocyclic Compounds,* Vol. 18, *The Cyanine Dyes and Related Compounds,* A. Weissberger ed., Interscience, New York, 1964; D. M. Sturmer, *The Chemistry of Heterocyclic Compounds,* Vol. 30, A. Weissberger and E. C. Taylor ed., John Wiley, New York, 1977, p. 411; *Research Disclosure,* 17643, 23–24 (1978), German Pat. No. 929,080, U.S. Pat. Nos. 2,231,658, 2,493,748, 2,503,776, 2,519,001, 2,912,329, 3,656,959, 3,672,897 and 3,694,217, British Pat. No. 1,242,588, and Japanese Patent Publication 14030/69.

The sulfur containing restrainer used in the present invention is a substance which substantially restrains the growth of silver halide grains. In other words, the restrainer is a substance which does not accelerate the growth of grains, i.e., a substance which controls the growth of the crystal habit of grains or directly restrains the growth of grains. In detail, it is a sulfur containing compound which is adsorbed on the surface of a silver halide grain by a mercapto group or a thiocarbonyl group and does not substantially accelerate the growth of silver chloride grains (namely, restrains or does not change particle size) by the following test (degree of restraint test). By using a deactivator in this test, it is possible to select a deactivator suitable for the purpose of the present invention.

Test: Degree of Restraint Test

No. 1

After a solution II is added over 30 seconds to a solution I kept at 70° C., the mixture is physically ripened for 20 minutes. Thereafter, it is diluted 11 times with water, and turbidity is measures using ANA-14S turbidimeter (manufactured by Tokyo KODEN Co., Ltd. (Japan)).

| | |
|---|---|
| Solution I: | |
| Inactive Gelatin | 5 g |
| Sodium Chloride | 350 mg |
| Sodium Hydroxide | to make pH 8 |
| Water | 55 ml |
| Sulfur Containing Restrainer | $8 \times 10^{-5}$ mol |
| Solution II: | |
| 0.1 N Aqueous Solution of $AgNO_3$ | 20 cc |

Since the compound which restrains the growth of the silver chloride grains, namely, the sulfur containing restrainer, renders particle size small, turbidity measured by the above described test becomes small as compared with the case wherein the compound is not added. The sulfur containing restrainer of the present invention means a compound which does not change or makes turbidity in the case of no addition of the compound when measured by this test smaller.

No. 2

Selection of a deactivator suitable for the purpose of the present invention is carried out as follows.

20 Minutes before adding the above solution II, $2\times10^{-2}$ mol of a deactivator to be tested are added to the above described solution I (and the following Compound (I-1) is added as the sulfur containing restrainer) kept at 70° C. Then, 20 minutes later, addition of solution II, physical ripening, dilution and measurement of turbidity are carried out according to the same procedure as in No. 1.

If turbidity in the case that (I-1) is present and a deactivator is not added (as described in No. 1, turbidity remains equal or becomes smaller per the addition of (I-1) as compared with the case of no addition of (I-1)) becomes large (namely, it comes near that in the case of no addition of (I-1)), such a deactivator is suitable for the purpose of the present invention.

Sulfur Containing Restrainer (I-1)

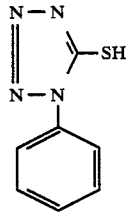

As the sulfur containing restrainers capable of use in the present invention, compounds having a mercapto group and nitrogen containing heterocyclic compounds having a thiocarbonyl group as described above are useful, e.g., the compounds described in Japanese Patent Application 79161/84 (filed on 19, Apr., 1984 by Fuji Photo Film Co., Ltd.), pages 10–29 (corresponding to U.S. Pat. Application No. 725,284 filed on Apr. 19, 1985).

As assistants for gold sensitization, there are thiourea compounds as described in Japanese Patent Application (OPI) 29829/80, pages 218 and 219.

As the deactivator used in the present invention, any compound can be used if it reduces or removes the function of the substance to be deactivated but does not have a harmful influence on photographic properties. As suitable deactivators, there are oxidizing agents.

As the oxidizing agents, inorganic oxidizing agents and organic oxidizing agents can be used.

In the following, examples of oxidizing agents are given.

As inorganic oxidizing agents, hydrogen peroxide (aqueous solution), adducts of hydrogen peroxide (for example, $NaBO_2 \cdot H_2O_2 \cdot 3H_2O$, $2NaCO_3 \cdot 3H_2O_2$, $Na_4P_2O_7 \cdot 2H_2O_2$, $2Na_2SO_4 \cdot H_2O_2 \cdot 2H_2O$, etc.), peroxy acid salts (for example, $K_2S_2O_8$, $K_2C_2O_6$, $K_4P_2O_8$, etc.), peroxy complex compounds (for example, $K_2[Ti(O_2)C_2O_4] \cdot 3H_2O$, $4K_2SO_4 \cdot Ti(O_2)OH \cdot SO_4 \cdot 2H_2O$, $Na_3[VO(O_2)(C_2O_4)_2] \cdot 6H_2O$, etc.), permanganates (for example, $KMnO_4$, etc.) and oxy acid salts such as chromic acid salts (for example, $K_2Cr_2O_7$, etc.), etc.

As organic oxidizing agents, organic peroxides (for example, peracetic acid, perbenzoic acid, etc.), etc.

In addition, it is possible to use oxidizing compounds such as an oxidizing gas (for example, ozone, oxygen gas, etc.), or oxidizing compounds which release a halogen (for example, sodium hypochlorite, N-bromosuccinimide, chloramine B (sodium benzenesulfonchloramide), chloramine T (sodium p-toluenesulfonchloramide), etc.), etc.

Whether the oxidizing agent is suitable for the purpose of the present invention or not can be determined by the above described test (degree of restraint test) No. 2. Compounds which do not decompose gelatin or do not have a strong desensitization function but deactivate substances to be deactivated are more suitable in the present invention. Such characteristics can be evaluated by the above described test (degree of restraint test) or by examining photographic properties by conventional methods.

Some oxidizing agents decompose gelatin or have a strong desensitization function (particularly, oxidizing agents which release halogen have such a harmful function). When such oxidizing agents are used in the present invention, it is necessary to use them in a smaller amount.

Of the above oxidizing agents, inorganic oxidizing agents and oxidizing gases are preferred. Hydrogen peroxide and adducts thereof, persulfates and ozone are preferred. Of the inorganic oxidizing agents, hydrogen peroxide and adducts thereof are particularly preferred.

Almost all of these oxidizing agents are available in the market or can be easily synthesized.

The amount of the substance to be deactivated used in the present invention can be arbitrarily determined according to the kind of substance to be deactivated or the time of addition, but it is preferably in the range of $10^{-7}$ mol to $10^{-1}$ mol, preferably $10^{-6}$ mol to $10^{-2}$ mol, per mol of silver halide.

The amount of the oxidizing agent can be suitably varied according to the amount of the substance to be deactivated. In the case that the function of the substance to be deactivated is required to be completely removed, it is necessary to add an equivalent mol weight or more based on the substance to be deactivated. In the case of deactivating to a necessary or desired degree, the amount to be added may be set based thereon. For example, the oxidizing agent can be used in an amount of 1/10 to 500 times by mol of the sulfur containing restrainer.

The substance to be deactivated or the oxidizing agent may be added by dissolving in water or a water soluble organic solvent (for example, alcohols, ethers, glycols, ketones, esters, amides, etc.).

Addition of the oxidizing agent may be carried out at any time of before addition of the substance to be deactivated, after addition thereof or both, but it is preferable to carry out addition of the oxidizing agent after addition of the substance to be deactivated.

In the case of using the oxidizing agent as a deactivator in the present invention, it is possible to carry out deactivation in the presence of nitric ions (for example, ammonium nitrate, potassium nitrate, etc.) or phosphoric ions.

These oxidizing agents may be previously added to an aqueous solution of silver salt or an aqueous solution of halogen salt (e.g., KCl, KBr, NaCl, NaBr, $NH_4Br$, KI or a mixture thereof).

These oxidizing agents are used generally in an amount of 1 to 20 g/mol Ag.

In the case of using the oxidizing agent, it is possible to carry out deactivation in the presence of a catalyst. As examples of the catalyst, there are a metal compound catalyst such as tungsten compounds, molybdenum compounds, vanadium compounds, osmium compounds, iron compounds or cupper compounds (e.g., sodium tungstate, potassium tungstate, molybdates, vanadium oxide, osmium oxide, iron salts, copper salts, etc.) These catalysts may be previously added before addition of the oxidizing agent or may be added simultaneously with or after addition of the oxidizing agent. Generally, they are used in an amount of 10 mg to 1 g/mol Ag.

In the case of using hydrogen peroxide as the oxidizing agent, it may be used together with a stabilizer such as phosphoric acid, barbituric acid, uric acid, acetanilide, oxyquinoline, sodium pyrophosphate, etc.

In the following, process for producing internal latent image type core/shell direct positive emulsions are described.

In order to dope the core with metal ion(s), it is possible to use a process where a metal ion source such as a cadmium salt(s), zinc salt(s), lead salt(s), thallium salt(s), iridium salt(s) or a complex salt(s) thereof, rhodium salt(s) or a complex salt(s) thereof, iron salt(s) or a complex salt(s) thereof, etc., is/are allowed to coexist in the step of formation of the silver halide grains (including the step of physical ripening). The metal ion(s) is/are used generally in an amount of $10^{-6}$ mol or more per mol of silver halide. The silver halide of the core may be chemically sensitized with one or more noble metal sensitizer(s), sulfur sensitizer(s) or reduction sensitizer(s) in place of or simultaneously with doping with the above described metal ion(s). Particularly, sensitivity increases by carrying out noble metal sensitization and sulfur sensitization. Such processing of the silver halide of the core and the process of covering the surface of the silver halide grain composing the core with silver halide of the shell are well known. For example, it is possible to advantageously use processes as described in U.S. Pat. Nos. 3,206,316, 3,317,322, 3,367,778 (excluding a fogging step for the surface of the grains) and 3,761,276.

The amount of silver halide in the core and the silver halide in the shell is arbitrary, but it is generally suitable to use the latter in an amount of 0.1 to 10 mols, more preferably 1 to 8 mols, per mol of the former.

The silver halide of the core and that of the shell preferably have the same composition, but they may have different compositions from each other. In the present invention, as the silver halide of the core and the shell, it is possible to use, for example, silver bromide, silver iodide, silver chloride, silver chlorobromide, silver bromoiodide, silver chlorobromoiodide, etc. Preferred silver halide comprises at least 50% by mol silver bromide. The most suitable case is where both the core and the shell are composed of silver bromide.

The present invention can be applied to core/shell silver halide grains having various particle sizes, but core/shell silver halide grains having an average particle diameter of about 0.1 and 2.5 microns, preferably about 0.2 to 2.5 microns, more preferably about 0.8 to 2.0 microns, produce good results.

The core/shell silver halide grains may have a regular crystal form such as cubic or octahedral, an irregular crystal form such as spherical or plate-like, or a mixed form of these crystal forms, or they may be composed of a mixture of grains having various different crystal forms. As internal latent image type core/shell silver halide emulsions having a plate-like form, those described in, for example, European Pat. No. 79583 and British Pat. Nos. 2,111,706A and 2,110,831A are very useful. The core/shell silver halide grains may or may not be monodispersed grains wherein particle size is substantially uniform.

Such core/shell silver halide grains are dispersed in a conventional binder.

As a binder, any substance may be used if it is known for use as a photographic binder, but gelatin is particularly advantageous.

The photographic emulsions of the present invention are not necessarily chemically sensitized (ripened) on the surface of the silver halide grains, but they may be chemically sensitized (ripened) to some degree, if desired. The photographic emulsions may also be spectrally sensitized by methine dyes, etc., in a conventional manner.

The photographic emulsions of the present invention directly yield a positive image by development in the presence of a nucleating agent or by developing using overall exposure of the total surface thereof. As nucleating agents capable of use in this case, typical examples include hydrazines as described in U.S. Pat. Nos. 2,588,982 and 2,563,785; hydrazides and hydrazones as described in U.S. Pat. No. 3,227,552; quaternary salt compounds as described in British Pat. No. 1,283,835, Japanese Patent Application (OPI) 69613/77, and U.S. Pat. Nos. 3,615,615, 3,519,494, 3,734,738, 4,094,683 and 4,115,122, etc., sensitizing dyes having a nucleating substituent showing a fogging action in the dye molecule as described in U.S. Pat. No. 3,718,470; thiourea bonding type acylhydrazine compounds as described in U.S. Pat. Nos. 4,030,925, 4,031,127, 4,245,037, 4,255,511, 4,266,013 and 4,276,364 and British Pat. No. 2,012,443; urea type acylhydrazine compounds as described in U.S. Pat. No. 4,374,923, etc.; and acylhydrazine compounds having a thioamide ring or a heterocyclic ring such as triazole or tetrazole as an adsorptive group as described in U.S. Pat. Nos. 4,080,270 and 4,278,748 and British Pat. No. 2,011,391, etc.

The amount of the nucleating agent used is preferred to be such that a sufficient maximum density is obtained when the photographic emulsion of the present invention is developed with a surface developing solution. In practice, since it varies according to characteristics of the silver halide emulsion used, the chemical structure of the nucleating agent and the developing condition, a suitable amount falls in a wide range. However, in the case of adding the nucleating agent in a developing solution, the amount is generally in the range of about 0.01 g to 5 g (preferably 0.05 g to 1 g) per liter of the developing solution. In the case of adding the nucleating agent to an emulsion layer, it is practically advantageous to use it in an amount of about 0.1 mg to 5 g per mol of silver in the photographic emulsion and preferably about 0.5 mg to about 2 g per mol of silver. In the case of adding the same to a hydrophilic colloid layer adjacent an emulsion layer, it may be added in the same amount as described above based on the amount of silver contained in the photographic emulsion layer having the same area.

The nucleating agent is preferably added to the photographic emulsion layer or a layer adjacent thereto.

The substances to be deactivated are preferred to be deactivated in, for example, the following stages.

(1) In the case that the substance to be deactivated (such as a sulfur containing silver halide solvent, a sulfur containing restrainer or a dye, etc.) is used in the formation of internal nucleus particles (core):

(a) After formation of the core particles but before chemical sensitization of the core particles, if the above described substance to be deactivated has a harmful influence upon photographic properties (for example, preventing chemical sensitization or increasing fog) in the case of carrying out chemical sensitization of the core particles.

(b) After chemical sensitization of the core particles but before formation of the shell, if the above described substance to be deactivated has no harmful influence or acts as an effective sensitizing assistant in the case of carrying out chemical sensitization of the core particles but has a harmful influence in the case of the formation of the shell.

(c) After formation of the shell but before the start of surface chemical sensitization (ripening) of the core/-shell emulsion, if the above described substance to be deactivated has no harmful influence or acts as an effective sensitizing assistant or an effective shell forming assistant in the case of carrying out chemical sensitization of the core particles and the formation of the shell but has a harmful influence in the case of carrying out surface chemical sensitization (ripening) of the core/-shell emulsion.

(d) After formation of the core particles but before formation of the shell, if the core particles are not chemically sensitized and the above described substance to be deactivated has a harmful influence in the case of formation of the shell.

(e) After formation of the shell but before the start of surface chemical sensitization (ripening) of the core/-shell emulsion, if the core particles are not chemically sensitized and the above described compound has no harmful influence or acts as an effective shell forming assistant in the case of formation of the shell but has a harmful influence in the case of carrying out surface chemical sensitization (ripening) of the core/shell emulsion.

(2) In the case that the substance to be deactivated, such as a sulfur sensitizer, a sulfur containing restrainer or a sulfur containing sensitizing assistant used for gold sensitization, is used for chemical sensitization of core particles:

(a) After chemical sensitization of the core particles but before formation of the shell, if the above described substance to be deactivated has a harmful influence in the case of the formation of the shell.

(b) After formation of the shell but before surface chemical sensitization (ripening) of the core/shell emulsion, if the above described substance to be deactivated has no harmful influence or acts as an effective shell forming assistant in the case of formation of the shell but has a harmful influence in the case of surface chemical sensitization (ripening) of the core/shell emulsion.

(3) After completion of shell formation but before surface chemical sensitization (ripening) of the core/-shell emulsion, if the substance to be deactivated such as a sulfur containing silver halide solvent, etc., is used in shell formation and it has a harmful influence in the case of surface chemical sensitization (ripening) of the core/-shell emulsion.

(4) Before completion of surface chemical sensitization (ripening) of the core/shell emulsion, if the substance to be deactivated such as a sulfur containing silver halide solvent, a sulfur containing restrainer, a dye, a sulfur containing sensitizing assistant for gold sensitization or a sulfur sensitizer, etc., has a harmful influence upon dissolution stability with the passage of time, preservation stability and adsorption of spectral sensitizing dyes after completion of the surface chemical sensitization (ripening) of the core/shell emulsion.

When a large amount of an oxidizing agent is used as a deactivator in the present invention, residual oxidizing agent may be deactivated by adding a reducing substance (for example, sulfites, sulfinic acid, reducing sugar, etc.) in a suitable stage so as not to have a harmful influence on chemical ripening or maintenance of photographic performance during preservation of the sensitive materials.

The reducing substance is used, preferably, after addition of the oxidizing agent.

The amount of the reducing substance(s) added varies according to the kind of oxidizing agent used or degree of deactivation. It is generally used in an equimolar amount or more based on the oxidizing agent, and, preferably, in a range of equimolar amount to 5 times by mol.

The photographic light-sensitive materials containing the direct positive photographic emulsion of the present invention can be applied to both black-white photography and color photography. As concrete uses for these sensitive materials, there are sensitive materials for photography, for printing, for plate making, for movies, for microphotography, x-ray sensitive materials, diffusion transfer materials, heat developable materials, materials for a silver dye bleach process, etc. The photographic emulsions of the present invention can be utilized in many fields.

In the case that the sensitive material is used for a color diffusion transfer process, dye developing agents can be used as dye image forming substances (coloring materials) but it is advantageous to use coloring materials which are nondiffusible (immobile) in alkaline conditions (developing solutions) but which release a diffusible dye (or precursor thereof) as a result of development. As the diffusible dye releasing coloring materials, there are couplers and redox compounds which release a diffusible dye, which can be used not only for color diffusion transfer processes (wet processes) but also are useful as coloring materials for heat developable sensitive materials (dry processes).

In the case that the sensitive material is used as a film unit for a diffusion transfer process, it is preferred to be processed with a viscous developing solution. The viscous developing solution is a liquid composition containing processing components necessary for development of silver halide emulsions (and formation of diffusion transfer dye images), where the main component of the solvent is water but which may contain hydrophilic solvents such as methanol or methyl cellosolve.

The above described composition is preferred to be used by putting it in a container destructible by pressure as described in U.S. Pat. Nos. 2,543,181, 2,643,886, 2,653,732, 2,723,051, 3,056,491, 3,056,492 and 3,152,515, etc.

In the case that the sensitive material is used in a color diffusion transfer process, the photographic emulsion may be applied to the same base to which an image receiving layer is applied, or may be applied to a different base. The silver halide photographic emulsion layers (light-sensitive element) and the image receiving layer (image receiving element) may be provided as a film unit in a combined state, or may be provided as separated photographic materials, respectively. The state of the film unit may be the type which is unitary throughout exposure, development and viewing of the transfer image, or may be the type where the film is separated after development.

The present invention will now be described in more detail with reference to the following examples. However, the present invention is not to be construed as being limited thereto.

EXAMPLE 1

An aqueous solution of potassium bromide and an aqueous solution of silver nitrate were simultaneously blended with an aqueous solution of gelatin containing potassium bromide with vigorous stirring at 75° C. for about 60 minutes to obtain a silver bromide emulsion (first precipitation). Before carrying out precipitation (before simultaneous blending), 3,4-dimethyl-1,3-thiazoline-2-thione was added to the aqueous solution of gelatin in an amount of 150 mg per mol of silver as a silver halide solvent. When precipitation was complete octahedral silver bromide crystals having a uniform particle size wherein the average particle size was about 0.8 micron were formed. To the resultant silver bromide grains, 4.8 mg per mol of silver of sodium thiosulfate and 2.4 mg per mol of silver of potassium chloroaurate were added, and chemical sensitization was carried out by heating at 75° C. for 80 minutes. To the resultant chemically sensitized internal nucleus (core) emulsion, an aqueous solution of potassium bromide and an aqueous solution of silver nitrate were simultaneously added and blended over 45 minutes at 75° C. in the same manner as above (i.e., the first precipitation) to prepare an internal latent image type core/shell emulsion (second precipitation). The final average particle size was 1.0 micron. This emulsion was washed with water by a conventional flocculation process. Thus, Emulsion (A) was obtained.

Emulsions (B), (C) and (D) were prepared by the same manner as for Emulsion (A), except that hydrogen peroxide was added as an oxidizing agent in amounts shown in Table 1 after completion of the second precipitation (formation of shell) and the emulsions were heated at 75° C. for 8 minutes and washed with water in the same manner as in Emulsion (A). The particle sizes of Emulsions (B), (C) and (D) were the same as that of Emulsion (A), and the average particle size was 1.0 micron.

To these Internal Latent Image Type Core/Shell Emulsions (A) to (D), 0.75 mg per mol of silver of sodium thiosulfate and 20 mg per mol of silver of poly(N-vinylpyrrolidone) were added, and the emulsions were heated to 60° C. to carry out chemical sensitization (ripening) of the surface of grains. When time of chemical sensitization (ripening) became 20 minutes, 40 minutes and 60 minutes, a sampling of each emulsion was carried out. After chemical sensitization, a nucleating agent as shown in the following was added in an amount of 6.8 mg per mol of silver. Then, sampled emulsions were applied to cellulose acetate film bases at silver 400 mg/ft$^2$ and gelatin 656 mg/ft$^2$.

Nucleating Agent:

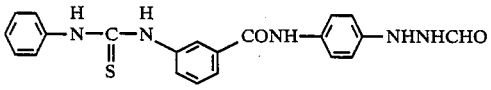

After each coated sample was exposed to tungsten light (1,000 lux for 1/100 seconds) through an optical wedge, it was developed with the following Developing Solution X at 20° C. for 8 minutes. Maximum density ($D_{max}$) and minimum density ($D_{min}$) of the reversal images on each developed coated sample were measured by a densitometer. The results are shown in Table 1.

| Developing Solution X: | |
|---|---|
| Sodium Sulfite | 30 g |
| Hydroquinone | 10 g |
| 1-Phenyl-4-methyl-4-hydroxymethyl-3-pyrazolidone | 0.75 g |
| Trisodium Phosphate | 40 g |

-continued

| Developing Solution X: | |
|---|---|
| Sodium Hydroxide | 10.7 g |
| 5-Methylbenzotriazole | 0.02 g |
| Water to make | 1 liter |

TABLE 1

| Emulsion | Amount of $H_2O_2$ Added* (g/Ag mol) | 20 Minutes** $D_{max}$ | 20 Minutes** $D_{min}$ | 40 Minutes** $D_{max}$ | 40 Minutes** $D_{min}$ | 60 Minutes** $D_{max}$ | 60 Minutes** $D_{min}$ |
|---|---|---|---|---|---|---|---|
| Emulsion (A) | Not Used | 0.74 | 0.08 | 1.59 | 0.08 | 2.09 | 0.08 |
| Emulsion (B) | 0.20 | 1.14 | 0.08 | 2.08 | 0.08 | 2.22 | 0.08 |
| Emulsion (C) | 0.60 | 1.78 | 0.08 | 2.28 | 0.08 | 2.29 | 0.08 |
| Emulsion (D) | 2.00 | 2.28 | 0.08 | 2.28 | 0.08 | 2.28 | 0.08 |

*$H_2O_2$ was added after completion of the second precipitation.
**Time for surface chemical sensitization of the internal latent image type core/shell silver halide emulsion.

It can be clearly seen from Table 1 that, in the emulsions prepared by adding hydrogen peroxide after completion of the second precipitation and heating, the maximum density ($D_{max}$) reached saturation in a short time in the case of carrying out surface chemical sensitization (ripening) and reversal performance was very stable. Further, it can be understood that the emulsions processed with hydrogen peroxide showed a high maximum value of $D_{max}$.

The reason therefor is believed to be that hydrogen peroxide decomposes the sulfur containing silver halide solvent (3,4-dimethyl-1,3-thiazoline-2-thione used in the case of preparing the internal latent image type core/shell emulsion) to deactivate it, whereby the "progress of surface post-ripening" is accelerated. In distinction, if a sulfur containing silver halide solvent as described above is present during surface chemical sensitization (ripening), the progress of surface post-ripening is very slow and the time for reaching saturated $D_{max}$ becomes very long.

The above described effect of hydrogen peroxide is also produced by other oxidizing agents, for example, potassium persulfate or perboric acid.

EXAMPLE 2

An Internal Latent Image Type Core/Shell Emulsion (E) was prepared in the same manner as in Emulsion (A) if Example 1, except that the amount of potassium chloroaurate used in the case of chemically sensitizing the internal nucleus (core) emulsion was increased to 3.0 mg (1.25 times Emulsion (A)).

Emulsion (F) was also prepared in the same manner as Emulsion (E), except that hydrogen peroxide was added in an amount of 2 g per mol of silver after completion of the second precipitation (formation of the shell) and heating was carried out at 75° C. for 8 minutes. Both Emulsion (E) and Emulsion (F) had an average particle size of 1.0 micron, the same as Emulsion (A). To Emulsions (E) and (F), 0.55 mg of sodium thiosulfate and 20 mg of poly(N-vinylpyrrolidone), per mol of silver, were added. To Emulsion (A), 0.75 mg of sodium thiosulfate and 20 mg of poly(N-vinylpyrrolidone), per mol of silver, were added. All samples were heated to 60° C. for 60 minutes to prepare Emulsions (E'), (F') and (A'), respectively.

To these emulsions, the nucleating agent shown in Example 1 was added in an amount of 6.8 mg per mol of silver, and they were applied to cellulose acetate film base at: silver 400 mg/ft$^2$ and gelatin 656 mg/ft$^2$.

Each coated sample was exposed to light in the same manner as in Example 1. Further, each coated sample was exposed to a xenon light ($6.6\times10^5$ lux for 1/10,000 second) through an optical wedge. Thereafter, each sample was developed in the same manner as in Example 1, and maximum density ($D_{max}$), minimum density ($D_{min}$) and the sensitivity of the re-reversal negative images were measured. The results are shown in Table 2.

It is easily seen from Table 2 that the sensitivity of the re-reversal negative images was reduced upon increasing the amount of potassium chloroaurate in the case of the chemical sensitization of the core emulsion, while maximum density ($D_{max}$) was remarkably reduced (Emulsion (E')). In distinction, it can be seen that Emulsion (F'), where hydrogen peroxide was added after the formation of the shell, had low sensitivity of the re-reversal negative image and high $D_{max}$. In order to increase the $D_{max}$ of Emulsion (E') (which was not subjected to processing with hydrogen peroxide), it was necessary to carry out excessive surface chemical sensitization of the core/shell emulsion. However, if such an operation is carried out, $D_{min}$ increases and the sensitivity of the re-reversal image, which was once reduced, increase.

By carrying out processing with hydrogen peroxide as described above, it is possible to prepare an internal latent image type core/shell emulsion causing less re-reversal negative images, an effect unknown from the prior art.

TABLE 2

| Emulsion | Amount of $H_2O_2$ Added (g/Ag mol) | $D_{max}$ | $D_{min}$ | Srel.* (negative) image) |
|---|---|---|---|---|
| Emulsion (A') | Not Used | 2.11 | 0.08 | 100 |
| Emulsion (E') | Not Used | 1.21 | 0.08 | 80 |
| Emulsion (F') | 2.00 | 2.18 | 0.08 | 80 |

*Srel. (negative image): Relative value of photographic sensitivity at a density of 0.2 higher than $D_{min}$.

EXAMPLE 3

Preparation of Internal Latent Image Type Core/Shell Emulsion

An aqueous solution of potassium bromide and an aqueous solution of silver nitrate were simultaneously blended with an aqueous solution of gelatin containing potassium bromide with vigorous stirring at 75° C. for about 15 minutes to obtain a silver bromide emulsion. Before carrying out precipitation, N,N'-dimethylethylenethiourea was added to the aqueous solution of gelatin in an amount of 250 mg per mol of silver. When precipitation was completed, silver bromide crystals having a uniform particle size where the average particle size was about 0.38 micron were formed. To the resultant silver bromide crystals, 14 mg per mol of silver of sodium thiosulfate and 5.8 mg per mol of silver of potassium chloroaurate were added, and chemical sensitization was carried out by heating at 75° C. for 90 minutes. To the resultant chemically sensitized core emulsion, an aqueous solution of potassium bromide and an aqueous solution of silver nitrate were simultaneously added and blended over 60 minutes in the same manner as for the first step to prepare an internal latent image type core/shell emulsion (Emulsion (G)).

Emulsions (H), (I) and (J) were prepared in the same manner as Emulsion (G), except that hydrogen peroxide was added in amounts of 1.5 g, 2.5 g and 3.5 g per mol of silver, respectively, after completion of the second precipitation (formation of shell) and heat treatment was carried out at 75° C. for 8 minutes. The final particle sizes of Emulsions (G) to (J) were the same and the average particle size was 0.65 micron.

After the above described Emulsions (G), (H), (I) and (J) were washed with water per a conventional flocculation process, 0.65 mg per mol of silver of sodium thiosulfate and 25 mg per mol of silver of poly(N-vinylpyrrolidone) were added thereto, and surface chemical sensitization (ripening) was carried out by heating at 60° C. for 60 minutes. Emulsions (G'), (H'), (I') and (J') were thus obtained.

Preparation of Finished Coating Emulsion

The above described Emulsions (G'), (H'), (I') and (J') were dissolved at 40° C. (in the dark) and the following chemicals were added with slow stirring to prepare finished coating emulsions.

| | |
|---|---|
| Red-sensitive sensitizing dye having the following structure | 0.19 g/mol of silver |
| 4-Hydroxy-6-methyl-1,3,3a,7-tetraazaindene | 0.7 g/mol of silver |
| Sodium 5-pentadecylhydroquinone-2-sulfonate | 15 g/mol of silver |
| Nucleating agent shown in Example 1 | 3.2 mg/mol of silver |

Red-Sensitive Sensitizing Dye:

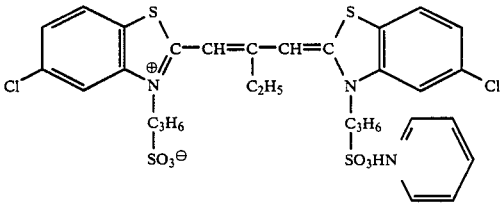

The pH and viscosity of the finished coating emulsion were adjusted to pH: 5.7 and viscosity: 60 cp (40°) in a conventional manner.

Using the finished coating emulsions (fresh finished coating solutions) prepared as described above, light-sensitive sheets were produced according to the following process.

In order to examine stability with the passage of time of the finished coating emulsions, the above described finished coating solutions were kept at 40° C. for 6 hours with slow stirring in a dark room. Using these finished coating solutions after passage of time, light-sensitive sheets were produced in the same manner as that using the above described fresh finished coating solutions.

Production of Light-Sensitive Sheet

Using the above described finished coating solutions (fresh finished coating solution and finished coating solution after passage of time), layers (1) to (6) were applied to polyethylene terephthalate transparent bases according to the following layer construction to produce light-sensitive sheets.

| | |
|---|---|
| Layer (6) | Protective layer containing gelatin |

-continued

| | |
|---|---|
| Layer (5) | Red-sensitive core/shell type direct positive emulsion layer |
| Layer (4) | Layer containing a cyan DRR compound |
| Layer (3) | Light-shielding layer |
| Layer (2) | White reflection layer |
| Layer (1) | Mordanting layer |
| | Base |

Layer (1): A mordanting layer containing a copolymer having the following repeating unit in the following rate (3.0 g/m$^2$) which is described in U.S. Pat. No. 3,898,088 and gelatin (3.0 mg/m$^2$).

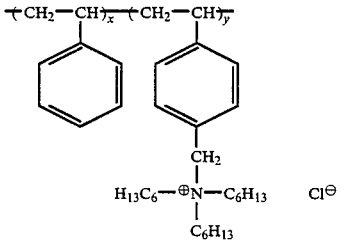

x:y = 50:50

Layer (2): A white reflection layer containing 20 g/m$^2$ of titanium oxide and 2.0 g/m$^2$ of gelatin Layer (3): A light-shielding layer containing 2.0 g/m$^2$ of carbon black and 1.5 g/m$^2$ of gelatin Layer (4): A layer containing the following cyan DRR compound (0.44 g/m$^2$), tricyclohexyl phosphate (0.09 g/m$^2$) and gelatin (0.8 g/m$^2$). Cyan DRR Compound

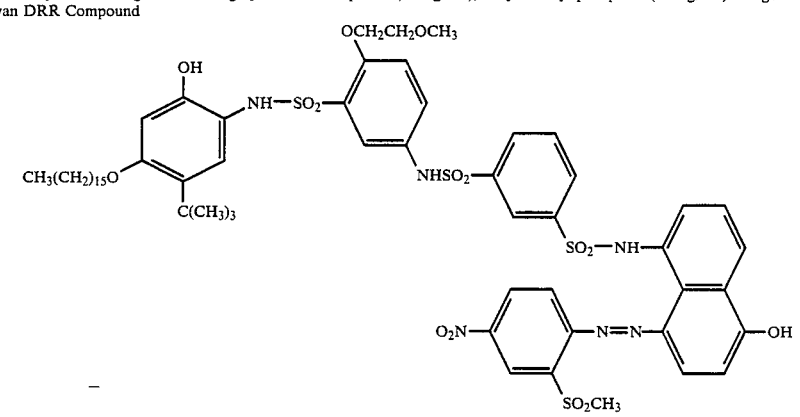

Layer (5): A red-sensitive core/shell type direct positive emulsion layer produced by applying the above described finished emulsion coating (fresh finished coating solution or finished coating solution after passage of time) so as to result in 0.72 g/m$^2$ as amount of silver (gelatin 0.64 g/m$^2$).

Layer (6): A protective layer containing gelatin (1.0 g/m$^2$)

The light-sensitive sheets produced as described above were exposed to light and subjected to development processing in combination with the following elements (Processing Solution Y and cover sheet), and the photographic properties ($D_{max}$, $D_{min}$) thereof were measured.

| Processing Solution Y: | |
|---|---|
| 1-p-Tolyl-4-methyl-4-hydroxymethyl-3-pyrazolidone | 12.0 g |
| Methylhydroquinone | 0.3 g |
| 5-Methylbenzotriazole | 3.5 g |
| Sodium Sulfite | 2.0 g |
| Carboxymethyl Cellulose (Na salt) | 58 g |
| Potassium Hydroxide | 56 g |
| Benzyl Alcohol | 1.5 g |
| Carbon Black Dispersion (25 wt %) | 600 g |
| Water to make | 1 kg |

0.8 g of the above described Processing Solution Y was put in each of containers destructible by pressure, respectively.

Cover Sheet

The following layers (1') to (3') were applied in order to a transparant polyethylene terephthalate base to produce a cover sheet.

| | |
|---|---|
| Layer (1'): | A neutralizing layer containing a 80:20 (ratio by weight) copolymer of acrylic acid and butyl acrylate (22 g/m$^2$) and 1,4-bis-(2,3-epoxypropoxy)butane (0.44 g/m$^2$). |
| Layer (2'): | A layer containing 3.8 g/m$^2$ of acetyl cellulose (39.4 g of acetyl groups formed by hydrolyzing 100 g of acetyl cellulose), 0.2 g/m$^2$ of a 60:40 (ratio by weight) copolymer of styrene and maleic acid anhydride (molecular weight: about 50,000) and 0.115 g/m$^2$ of 5-(β-cyanoethylthio)-1-phenyltetrazole. |
| Layer (3'): | A layer containing a 85:12:3 (ratio by weight) copolymer latex of vinylidene chloride, methyl acrylate and acrylic acid (2.5 g/m$^2$) and a polymethyl methacrylate latex (particle size: 1 to 3 μm) (0.05 g/m$^2$). |

Exposure and Development Processing

The above described cover sheet was superimposed on the above described light-sensitive sheet, and image-wise exposure was carried out from the cover sheet side through a continuous gradation wedge. Thereafter, the above described Processing Solution Y included in the container described above was spread between both sheets to a thickness of 75 μm (spreading was carried out by means of a pressure roll). The processing was carried out at 25° C. After 1 hour from the start of processing, the cyan density of the transfer images formed on the mordanting layer (image receiving layer) was measured through the transparent base of the light-sensitive sheet by means of a Macbeth reflection densitometer. The results obtained are shown in Table 3.

TABLE 3

| Emulsion | Amount of $H_2O_2$ Added (g/mol Ag) | Fresh $D_{max}$ | Fresh $D_{min}$ | After Passage of Time (40° C., 6 hours) $D_{max}$ | After Passage of Time (40° C., 6 hours) $D_{min}$ | Change of $D_{max}$ with Passage of Time ($\Delta D_{max}$*) |
|---|---|---|---|---|---|---|
| Emulsion (G') | Not Used | 1.85 | 0.32 | 1.25 | 0.32 | −0.60 |
| Emulsion (H') | 1.5 | 1.98 | 0.32 | 1.60 | 0.33 | −0.36 |
| Emulsion (I') | 2.5 | 2.02 | 0.32 | 1.78 | 0.32 | −0.24 |
| Emulsion (J') | 3.5 | 1.96 | 0.32 | 1.76 | 0.32 | −0.20 |

*$\Delta D_{max} = D_{max}$ (after passage of time) - $D_{max}$ (fresh)

It can be understood from Table 3 that when the finished coating emulsion is kept at 40° C. for a long time, the $D_{max}$ of re-reversal image is fairly reduced. On the contrary, in the emulsions processed with hydrogen peroxide after completion of the second precipitation (formation of the shell), it can be seen that stability with the passage of time of the finished coating emulsions is fairly improved.

EXAMPLE 4

Emulsions were prepared by the same process as in Emulsion (A) of Example 1, except that hydrogen peroxide was added in amounts of 1.2 g, 2.0 g and 3.0 g per mol of silver, respectively, 5 minutes before the completion of the second precipitation (formation of the shell) and the emulsions were processed at 75° C. for 15 minutes. Emulsions (K), (L) and (M) were thus obtained.

The above described four emulsions (Emulsions (A), (K), (L) and (M) were then subjected to surface chemical ripening for 60 minutes under the same conditions as in Example 1. Emulsions (A'), (K'), (L') and (M') were thus obtained.

These emulsions were applied to transparent polyethylene terephthalate bases in the same manner as described in Example 3 to produce light-sensitive sheets. (Light-sensitive sheets corresponding to Emulsions (A'), (K'), (L') and (M') are defined as Light-Sensitive Sheets (I), (II), (III) and (IV), respectively.) In this case, the finished coating emulsions were applied in the fresh state, i.e., not subjected to the passage of time.

Then, in order to examine the preservation stability of the above described Light-Sensitive Sheets (I) to (IV), testing with compulsory passage of time was carried out by preserving these light-sensitive sheets under conditions of 60° C. and 10% R.H. for 3 days or under conditions of 45° C. and 70% R.H. for 3 days, and they were subjected to exposure and development processing in the same manner as in Example 3 together with light-sensitive sheets which were not subjected to the testing with compulsory passage of time. After 1 hour from processing, the density was measured in the same manner as in Example 3. The results are shown in Table 4.

It can be understood from the results shown in Table 4 that with the light-sensitive sheets using the emulsions subjected to processing with hydrogen peroxide the reduction in $D_{max}$ due to the compulsory passage of time was remarkably improved.

TABLE 4

| Light-Sensitive Sheet | Emulsion | Amount of $H_2O_2$ Added (g/mol Ag) | No Compulsory Passage of Time $D_{max}$ | No Compulsory Passage of Time $D_{min}$ | 60° C., 10% RH 3 Days $D_{max}$ | 60° C., 10% RH 3 Days $D_{min}$ | 45° C., 70% RH 3 Days $D_{max}$ | 45° C., 70% RH 3 Days $D_{min}$ |
|---|---|---|---|---|---|---|---|---|
| (I) | (A') | Not Used | 2.00 | 0.32 | 0.56 | 0.31 | 0.79 | 0.31 |
| (II) | (K') | 1.2 | 2.15 | 0.32 | 1.15 | 0.32 | 0.86 | 0.32 |
| (III) | (L') | 2.0 | 2.18 | 0.32 | 1.88 | 0.32 | 1.08 | 0.32 |
| (IV) | (M') | 3.0 | 2.30 | 0.32 | 2.18 | 0.32 | 1.64 | 0.32 |

EXAMPLE 5

Using Emulsions (A') and (L') produced per Example 4, Light-Sensitive Sheets (V) and (VI) were produced by applying to light-shielded polyethylene terephthalate film bases containing 12% by weight of carbon black layers according to the following layer construction.

| | |
|---|---|
| Layer (12') | Protective layer containing gelatin |
| Layer (11') | Ultraviolet ray absorbing layer |
| Layer (10') | Blue-sensitive core/shell type direct positive emulsion layer |
| Layer (9') | Layer containing a yellow DRR compound |
| Layer (8') | Intermediate layer containing gelatin |
| Layer (7') | Color stain preventing layer |
| Layer (6') | Green-sensitive core/shell type direct positive emulsion layer |
| Layer (5') | Layer containing a magenta DRR compound |
| Layer (4') | Intermediate layer containing gelatin |
| Layer (3') | Color stain preventing layer |
| Layer (2') | Red-sensitive core/shell type direct positive emulsion layer |
| Layer (1') | Layer containing cyan DRR compounds |
| Layer (1') | A layer containing the same cyan DRR compound (0.44 g/m$^2$) as in Example 3, tricyclohexyl phosphate (0.99 g/m$^2$), 2,5-di-t-pentadecylhydroquinone (0.008 g/m$^2$) and gelatin (0.8 g/m$^2$). |
| Layer (2') | A red-sensitive core/shell type direct positive emulsion layer containing the following emulsion (0.52 g/m$^2$ as amount of |

-continued silver), a red-sensitive sensitizing dye, 0.011 mg/m$^2$ of the compound used in Example 1 as a nucleating agent, 3.4 mg/m$^2$ of 4-hydroxy-6-methyl-1,3,3a,7-tetra-azaindene and sodium 5-pentadecylhydro-quinone-2-sulfonate (0.062 g/m$^2$).

Light-sensitive sheet (V): Emulsion (A') in Example 4
Light-sensitive sheet (VI): Emulsion (L') in Example 4

Layer (3') A layer containing 0.43 g/m$^2$ of 2,5-di-t-pentadecylhydroquinone, 0.1 g/m$^2$ of trihexyl phosphate and 0.4 g/m$^2$ of gelatin.

Layer (4') An intermediate layer containing 0.18 g/m$^2$ of gelatin.

Layer (5') A layer containing a magenta DRR compound having the following structural formula I (0.21 g/m$^2$), a magenta DRR compound having the following structural formula II (0.11 g/m$^2$), tricyclohexyl phosphate (0.08 g/m$^2$) and gelatin (0.9 g/m$^2$).

Structural Formula I:

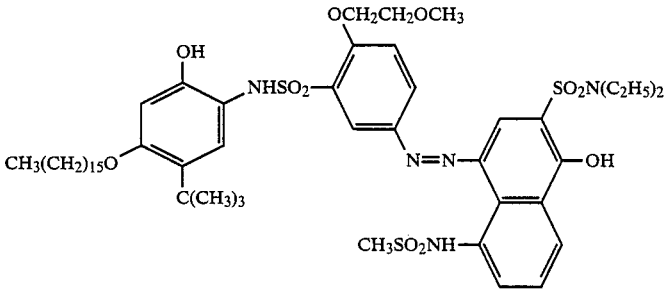

Structural Formula II:

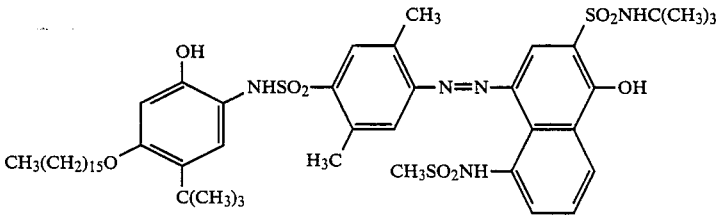

Layer (6') A green-sensitive core/shell type direct positive emulsion layer containing the following emulsion (0.48 g/m$^2$ as amount of silver), a green-sensitive sensitizing dye, 0.009 mg/m$^2$ of the nucleating agent used in Example 1, 2.8 mg/m$^2$ of 4-hydroxy-6-methyl-1,3,3a,7-tetraazaindene and sodium 5-pentadecylhydroquinone-2-sulfonate (0.074 g/m$^2$).

Light-sensitive sheet (V): Emulsion (A') in Example 4.
Light-sensitive sheet (VI): Emulsion (L') in Example 4.

Layer (7') The same layer as the above described layer (3').

Layer (8') The same layer as the above described layer (4').

Layer (9') A layer containing the following yellow DRR compound (0.53 g/m$^2$), tricyclohexyl phosphate (0.13 g/m$^2$) and gelatin (0.7 g/m$^2$).

-continued

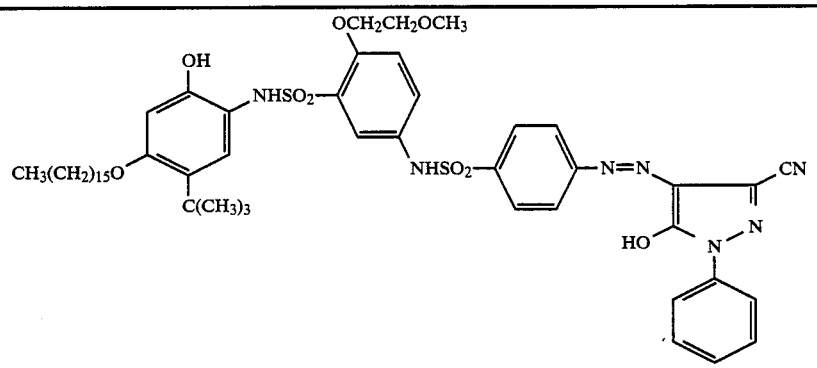

Layer (10') A blue-sensitive core/shell type direct positive emulsion layer containing the following emulsion (0.72 g/m$^2$ as amount of silver), a blue-sensitive sensitizing dye, 0.021 mg/m$^2$ of the nucleating agent used in Example 1, 1.5 mg/m$^2$ of 4-hydroxy-6-methyl-1,3,3a,7-tetraazaindene and sodium 5-pentadecylhydroquinone-2-sulfonate (0.051 g/m$^2$).

| | |
|---|---|
| Light-sensitive sheet (V): | Emulsion (A') in Example 4. |
| Light-sensitive sheet (VI): | Emulsion (L') in Example 4. |

Layer (11') An ultraviolet ray absorbing layer containing each of ultraviolet ray absorbing agents having the following structures (a) and (b) in an amount of $4 \times 10^{-4}$ mol/m$^2$, respectively, and 0.50 g/m$^2$ of gelatin.

Ultraviolet Ray Absorbing Agent (a):

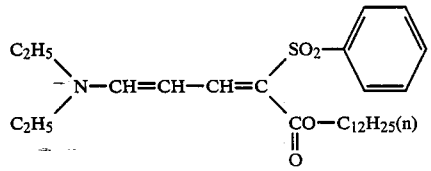

Ultraviolet Ray Absorbing Agent (b):

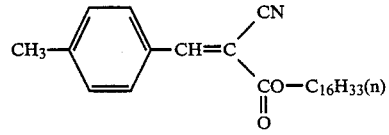

Layer (12') A protective layer containing 0.10 g/m$^2$ of a polymethyl methacrylate latex (average particle size: 4 μm), 0.8 g/m$^2$ of gelatin and 0.02 g/m$^2$ of triacryloyltriazine.

In order to examine the preservation stability of Light-Sensitive Sheets (V) and (VI) produced as described above, they were preserved under the following three conditions.

(a) Preservation at 60° C. and 10% R.H. for 3 days.

(b) Preservation at 45° C. and 80% R.H. for 3 days.

(c) Preservation at 35° C. and 80% R.H. for 6 days.

Then, the light-sensitive sheets subjected to the compulsory passage of time under the above described conditions (a), (b) and (c) and light-sensitive sheets (fresh) which were not subjected to the compulsory passage of time were exposed to light through an optical wedge, and the following image receiving sheet was superimposed thereon. Development processing was carried out by spreading Processing Solution Z (described in the following) put in a "container destructible by pressure" between both sheets to provide a solution thickness of 65 μm upon rupture where spreading was carried out by means of a pressure roll.

The spreading development processing was carried out at 25° C. After 90 seconds from the introduction of the processing solution, the light-sensitive sheet and the image receiving sheet were separated. After separation, the photographic properties ($D_{max}$, $D_{min}$) of the color positive images formed on the mordanting layer of the image receiving layer were measured by a color reflection densitometer. The results obtained are shown in Table 5.

Production of Image Receiving Sheet

To the reverse side of a light-shielding paper base prepared by applying a carbon black containing layer, the following layers (1″) to (5″) were applied in order to produce an image receiving sheet.

(1″) A neutralizing layer containing 17 g/m$^2$ of polyacrylic acid, 0.06 g/m$^2$ of N-hydroxysuccinimidobenzene sulfonate and 0.5 g/m$^2$ of ethylene glycol, applied so as to have a thickness of 7 microns.

(2″) A timing layer prepared by applying acetyl cellulose (degree of acetylation: 54) so as to have a thickness of 2 microns.

(3″) A timing layer prepared by applying a copolymer latex of vinylidene chloride and acrylic acid so as to have a thickness of 4 microns.

(4″) A mordanting layer containing 4.0 g/m$^2$ of copoly(styrene-N-vinylbenzyl-N,N,N-trihexylammonium chloride) and 4.0 g/m$^2$ of gelatin.

(5″) A separation layer containing phthalated gelatin (2.0 g/m$^2$).

| Processing Solution Z: | |
|---|---|
| 1-p-Tolyl-4-hydroxymethyl-4-methyl-3-pyrazolidone | 8.0 g |
| Methylhydroquinone | 0.1 g |
| 5-Methylbenzotriazole | 5.0 g |
| Sodium Sulfite (anhydrous) | 2.0 g |
| Hydroxyethyl Cellulose | 40 g |
| Potassium Hydroxide | 56 g |
| Benzyl Alcohol | 2.0 g |
| Water to make | 1 kg |

It can be understood from the results shown in Table 5 that when Light-Sensitive Sheet (V) is preserved under high temperature conditions, $D_{max}$ is reduced (particularly, the reduction of cyan density is great), but Light-Sensitive Sheet (IV) using Emulsion (L′) processed with hydrogen peroxide has remarkably improved preservation stability at high temperature or high humidity as compared with Light-Sensitive Sheet (V).

TABLE 5

| Light-Sensitive Sheet | Emulsion | Amount of $H_2O_2$ Added (g/mol Ag) | | No Compulsory Passage of Time | | 60° C., 10% RH 3 Days | | 45° C., 80% RH 3 Days | | 35° C., 80% RH 6 Days | |
|---|---|---|---|---|---|---|---|---|---|---|---|
| | | | | $D_{max}$ | $D_{min}$ | $D_{max}$ | $D_{min}$ | $D_{max}$ | $D_{min}$ | $D_{max}$ | $D_{min}$ |
| (V) | (A′) | Not Used | Y* | 2.50 | 0.14 | 2.20 | 0.16 | 1.92 | 0.13 | 2.48 | 0.14 |
| | | | M | 2.42 | 0.16 | 1.90 | 0.16 | 1.93 | 0.16 | 2.20 | 0.16 |
| | | | C | 2.91 | 0.19 | 2.25 | 0.18 | 1.48 | 0.18 | 2.28 | 0.18 |
| (VI) | (L′) | 2.0 | Y | 2.45 | 0.14 | 2.43 | 0.15 | 2.20 | 0.14 | 2.45 | 0.14 |
| | | | M | 2.40 | 0.16 | 2.04 | 0.16 | 2.08 | 0.16 | 2.41 | 0.16 |
| | | | C | 3.20 | 0.18 | 3.18 | 0.18 | 2.70 | 0.18 | 3.18 | 0.18 |

*Y, M and C indicate yellow density, magenta density and cyan density, respectively.

While the invention has been described in detail and with reference to specific embodiments thereof, it will be apparent to one skilled in the art that various changes and modifications can be made therein without departing from the spirit and scope thereof.

What is claimed is:

1. In an internal latent image type direct positive silver halide emulsion containing core/shell type silver halide grains wherein at least light-sensitive sites of the silver halide internal core which has been subjected to doping with metal ions or chemical sensitization, or both, is covered with a silver halide outer shell, the improvement wherein a photographic additive which is adsorbed on silver halide in said emulsion or interacts with silver ion, said additive being a compound which functions to change to crystal form or particle size of the silver halide grains in the case of the formation thereof or acts as a sensitizer or a sensitizing assistant in the case of chemically sensitizing the core particles but has a harmful influence on photographic properties if it remains after use of it, is deactivated by a deactivator prior to completion of the formation of said core/shell type silver halide grains or completion of surface chemical ripening of said grains, wherein said deactivator is an oxidizing agent and is present in an amount of $10^{-7}$ mol to $10^{-1}$ mol per mol of silver halide.

2. An internal latent image type direct positive silver halide emulsion as in claim 1, wherein said photographic additive is a dye or a sulfur containing compound which is adsorbed on silver halide through a sulfur atom.

3. An internal latent image type direct positive silver halide emulsion as in claim 2, wherein said sulfur containing compound is a sulfur containing silver halide solvent, a sulfur containing restrainer or a sulfur containing sensitizing agent.

4. An internal latent image type direct positive silver halide emulsion as in claim 2, wherein said dye is a methine dye including a polymethine dye and a azapolymethine dye.

5. An internal latent image type direct positive silver halide emulsion as in claim 2, wherein said oxidizing agent is hydrogen peroxide, an adduct thereof, persulfate or ozone.

6. An internal latent image type direct positive silver halide emulsion as in claim 2, wherein said oxidizing agent is used in the presence of a nitric ion or a phosphoric ion.

7. An internal latent image type direct positive silver halide emulsion as in claim 2, wherein said oxidizing agent is used in the presence of a metal compound catalyst selected from tungsten compounds, vanadium compounds, osmium compounds, iron compounds and copper compounds.

8. An internal latent image type direct positive silver halide emulsion as in claim 1, wherein said photographic additive used in the case of formation of internal core is deactivated after formation of the core but before chemical sensitization of the core.

9. An internal latent image type direct positive silver halide emulsion as in claim 1, wherein said photographic additive used in the case of formation of internal core is deactivated after chemical sensitization of the core but before formation of the outer shell.

10. An internal latent image type direct positive silver halide emulsion as in claim 1, wherein said photographic additive used in the case of formation of internal core is deactivated after formation of the shell but before the start of surface chemical sensitization of the core/shell emulsion.

11. An internal latent image type direct positive silver halide emulsion as in claim 1, wherein said photographic additive used in the case of formation of internal core is deactivated after formation of the core but before formation of the shell.

12. An internal latent image type direct positive silver halide emulsion as in claim 1, wherein said photographic additive used for chemical sensitization of the core is deactivated after chemical sensitization of the core but before formation of the shell.

13. An internal latent image type direct positive silver halide emulsion as in claim 1, wherein said photographic additive used for chemical sensitization of the core is deactivated after formation of the shell but before surface chemical sensitization of the core/shell emulsion.

14. An internal latent image type direct positive silver halide emulsion as in claim 1, wherein said photographic additive used in the case of shell formation is deactivated after completion of the shell formation but before surface chemical sensitization of the core/shell emulsion.

15. An internal latent image type direct positive silver halide emulsion according to claim 1, wherein said deactivator is present in an amount of $10^{-6}$ and $10^{-2}$ mol per mol of silver halide.

16. In an internal latent image type direct positive silver halide emulsion containing core/shell type silver halide grains wherein at least light-sensitive sites of the silver halide internal core which has been subject to doping with metal ions or chemical sensitization, or both, is covered with a silver halide outer shell, the improvement wherein a photographic additive which is absorbed on silver halide in said emulsion or interacts with silver ion, said additive being a compound which functions to change the crystal form or particle size of the silver halide grains in the case of the formation thereof or acts as a sensitizer or a sensitizing assistant in the case of chemically sensitizing the core particles but has a harmful influence on photographic properties if it remains after use of it, is deactivated by a deactivator prior to completion of the formation of said core/shell type silver halide grains or completion of surface chemical ripening of said grains, wherein said deactivator is hydrogen peroxide.

17. An internal latent image type direct positive silver halide emulsion as in claim 16, wherein said hydrogen peroxide is present in an amount of $10^{-7}$ mol to $10^{-1}$ per mol of silver halide.

18. An internal latent image type direct positive silver halide emulsion as in claim 16, wherein said hydrogen peroxide is present in an amount of $10^{-6}$ mol to $10^{-2}$ per mol of silver halide.

19. In a process for producing an internal latent image type direct positive silver halide emulsion containing core/shell type silver halide grains which comprises forming silver halide internal core which has been subjected to doping with metal ions or chemical sensitization, or both, and thereafter covering at least light-sensitive sites of said internal core with an outer shell, the improvement which comprises using a photographic additive which functions to change the crystal form or particle size of the silver halide grains in the case of the formation thereof or acts as a sensitizer of a sensitizing assistant in the case of chemically sensitizing the core particles but has a harmful influence on photographic properties if it remains after use, said photographic additive being adsorbed on silver halide in the emulsion or interacts with silver ions, and thereafter deactivating the additive with a deactivator prior to the completion of the formation of said core/shell silver halide grains or completion of surface chemical ripening of said grains, wherein said deactivator is an oxidizing agent and is present in an amount of $10^{-7}$ mol to $10^{-1}$ mol per mol of silver halide.

20. A process according to claim 19, wherein said photographing additive is a dye or a sulfur containing compound which is adsorbed on silver halide through a sulfur atom.

21. A process according to claim 20, wherein said sulfur containing compound is a sulfur containing silver halide solvent, a sulfur containing restrainer or a sulfur containing sensitizing assistant.

22. A process according to claim 20, wherein said dye is a methine dye including a polymethine dye and an azapolymethine dye.

23. A process according to claim 20, wherein said oxidizing agent is hydrogen peroxide, an adduct thereof, persulfate or ozone.

24. A process according to claim 20, wherein said oxidizing agent is used in the presence of a nitric ion or a phosphoric ion.

25. A process according to claim 20, wherein said oxidizing agent is used in the presence of a metal compound catalyst selected from tungsten compounds, vanadium compounds, osmium compounds, iron compounds and copper compounds.

26. A process according to claim 20, wherein said oxidizing agent is used in the presence of a stabilizer selected from phosphoric acid, barbituric acid, uric acid, acetanilide, oxyquinoline and sodium pyrophosphate.

27. A process according to claim 19, wherein said photographic additive used in the case of formation of internal core is deactivated after formation of the core but before chemical sensitization of the core.

28. A process according to claim 19, wherein said photographic additive used in the case of formation of internal core is deactivated after chemical sensitization of the core but before formation of the outer shell.

29. A process according to claim 19, wherein said photographic additive used in the case of formation of internal core is deactivated after formation of the shell but before the start of surface chemical sensitization of the core/shell emulsion.

30. A process according to claim 19, wherein said photographic additive used in the case of formation of internal core is deactivated after formation of the core but before formation of the shell.

31. A process according to claim 19, wherein said photographic additive used for chemical sensitization of the core is deactivated after chemical sensitization of the core but before formation of the shell.

32. A process according to claim 19, wherein said photographic additive used for chemical sensitization of the core is deactivated after formation of the shell but before surface chemical sensitization of the core/shell emulsion.

33. A process according to claim 19, wherein said photographic additive used in the case of shell formation is deactivated after completion of the shell formation but before surface chemical sensitization of the core/shell emulsion.

34. In a process for producing an internal latent image type direct positive silver halide emulsion containing core/shell type silver halide grains which comprises forming silver halide internal core which has been subjected to doping with metal ions or chemical sensitization, or both, and thereafter covering at least light-sensitive sites of said internal core with an outer shell, the improvement which comprises using a photographic additive which functions to change the crystal form or particle size of the silver halide grains in the case of the formation thereof or acts as a sensitizer or a sensitizing assistant in the case of chemically sensitizing the core particles but has a harmful influence on photographic properties if it remains after use, said photographic additive being adsorbed on silver halide in the emulsion or interacts with silver ions, and thereafter deactivating the additive with a deactivator prior to the completion of the formation of said core/shell silver halide grains or completion of surface chemical ripening of said grains, wherein said deactivator is hydrogen peroxide.

35. A process according to claim 34, wherein said hydrogen peroxide is present in an amount of $10^{-7}$ mol to $10^{-1}$ per mol of silver halide.

36. A process according to claim 34, wherein said hydrogen peroxide is present in an amount of $10^{-6}$ mol to $10^{-2}$ per mol of silver halide.

* * * * *